US006386739B1

(12) United States Patent
Wu

(10) Patent No.: US 6,386,739 B1
(45) Date of Patent: May 14, 2002

(54) STRUCTURE FOR SEPARABLE LAMP COVER

(76) Inventor: Wen-Chang Wu, No. 10, Lane 191, Hsi Hsin Street, Chuang Ya Tsun, Hsiu Shui Hsiang Chang Hua Hsien (TW)

( * ) Notice: Subject to any disclaimer, the term of this patent is extended or adjusted under 35 U.S.C. 154(b) by 0 days.

(21) Appl. No.: 09/782,049

(22) Filed: Feb. 14, 2001

(51) Int. Cl.[7] ..... F21V 17/00

(52) U.S. Cl. ..... 362/450; 362/351; 362/352; 362/355; 362/356; 362/357; 362/358; 362/434

(58) Field of Search ..... 362/351, 352, 362/355, 356, 357, 358, 434, 450

(56) References Cited

U.S. PATENT DOCUMENTS 4,354,222 A * 10/1982 Gall ..... 362/352
4,718,402 A * 1/1988 Fordyce ..... 126/337 R
5,662,412 A * 9/1997 Glendmyer ..... 362/351

* cited by examiner

*Primary Examiner*—Stephen Husar
*Assistant Examiner*—Guiyoung Lee
(74) *Attorney, Agent, or Firm*—Troxell Law Office PLLC

(57) ABSTRACT

The invention has a top ring, a bottom ring, of which the perimeter is greater than that of the top ring, and a support frame connecting the top ring and the bottom ring. Near the support portion of a support frame, there are support bars extending radiantly from the top ring and the end of the bars are bent upward to fasten the clip hooks on the ring rim. After the assembly of the support frame, the upper transversal arch bars exactly hit the bottom rim of the clip hook on the top ring to firmly fix the support frame. Also, near the support portion on a support frame, there are fixture bases located accordingly on the bottom ring for the insert and positioning of bottom bars on the support frame. The lamp cover can thus be assembled with minimum volume to achieve the objectives of easy assembly and to reduce storage volume and delivery cost.

7 Claims, 8 Drawing Sheets

STRUCTURE FOR SEPARABLE LAMP COVER

BACKGROUND OF THE INVENTION

1) Field of the Invention

The invention is related to a kind of improved structure for a separable lamp cover. Near the top ring, the ends of the bars are bent upward to fasten the clip hooks on the ring rim. After the assembly of the support frame, the upper transversal arch bars exactly hit the bottom rim of the clip hooks on the top ring to fix the support frame. Also, near the support portion on a support frame, there are fixture bases located accordingly on the bottom ring for the insert and positioning of bottom bar on the support frame. During assembly, one may lay the support frame horizontally or rotate it in horizontal state. The lamp cover can thus be assembled with minimum volume to achieve the objectives of easy assembly and to reduce the storage volume and delivery cost.

2) Description of the Prior Art

Please refer FIG. 8, the traditional lamp cover 5. Most of the support frames directly connect the top ring and the bottom ring to form the lamp cover structure. There are many practical defectives for this kind of lamp cover structure as follows:

The prior lamp covers form certain structural shape, therefore, the covers can not be compressed during delivery and the products take too much space. The storage and delivery volume for this kind of product can not be reduced, hence the delivery cost is raised. It leads to cost increase.

On the basis of thorough research for constant improvement, the inventor finally developed the invention, a kind of lamp cover for easy assembly and great improvement in practical usage.

SUMMARY OF THE INVENTION

The primary objective of the invention is to provide a kind of lamp cover structure, which mainly comprises of a top ring, a bottom ring, and a support frame, which exactly connects the top ring and the bottom ring. The top ring extrudes radiantly to form support bars. The ends of support bars are bent upward to form clip hooks for the fixture of the ring rim. After the assembly, the upper transversal arch bar on the support frame hit exactly the clip hooks on the top ring to fasten the support frame. Also, near the support portion on a support frame, there are fixture bases located accordingly on the bottom ring for the insert and positioning of bottom bar on the support frame. During assembly, one may lay the support frame horizontally. The lamp cover can thus be assembled with minimum volume to achieve the objectives of easy assembly and to reduce delivery cost.

The followings are brief description and legend for optimal embodiments of the invention for committee's better understanding in the structural characteristics and operations of the invention.

DETAILED DESCRIPTION OF THE PREFERRED EMBODIMENT

Figure 1:
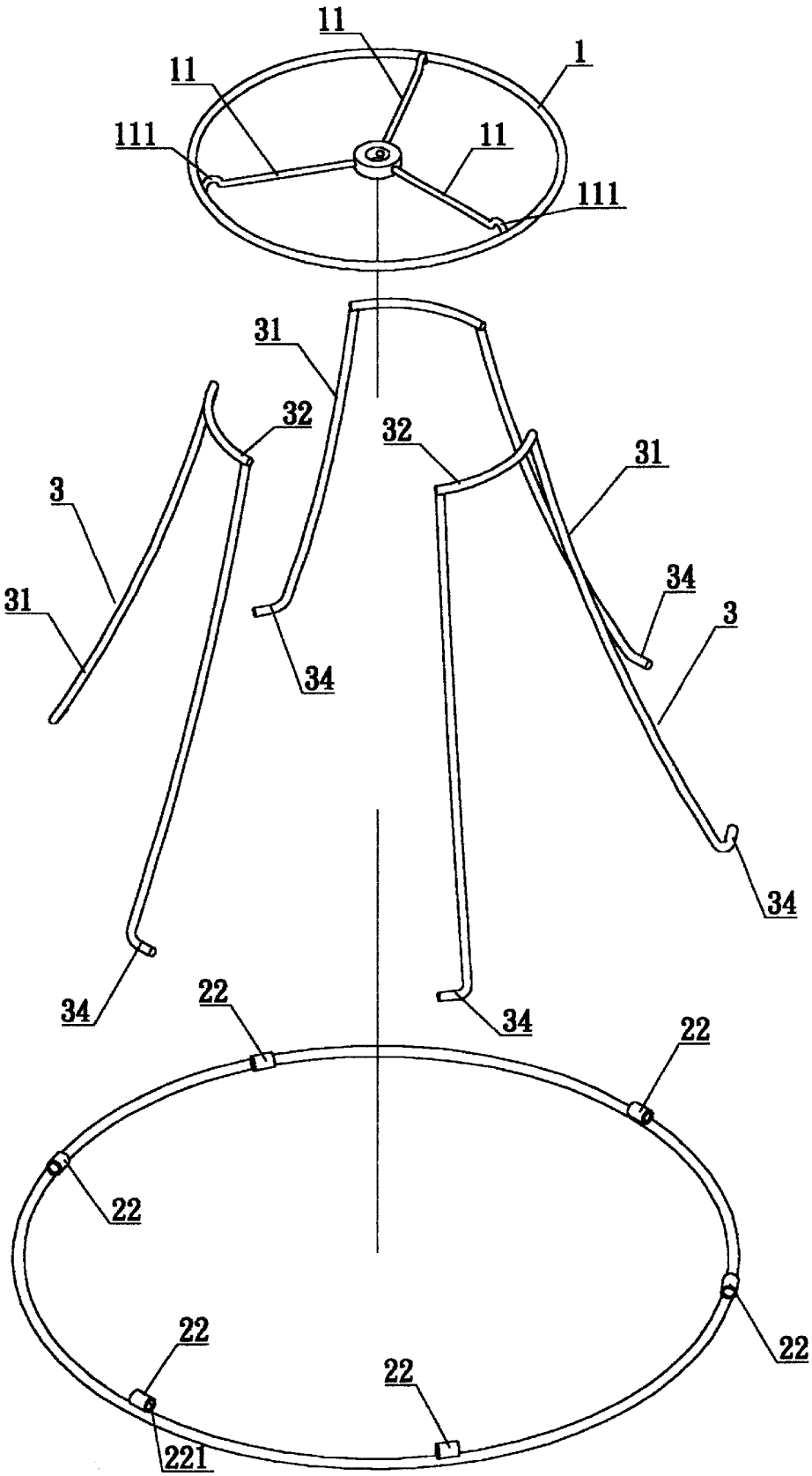
FIG. 1 is an exploded drawing of the invention.
Figures 2, 2A:
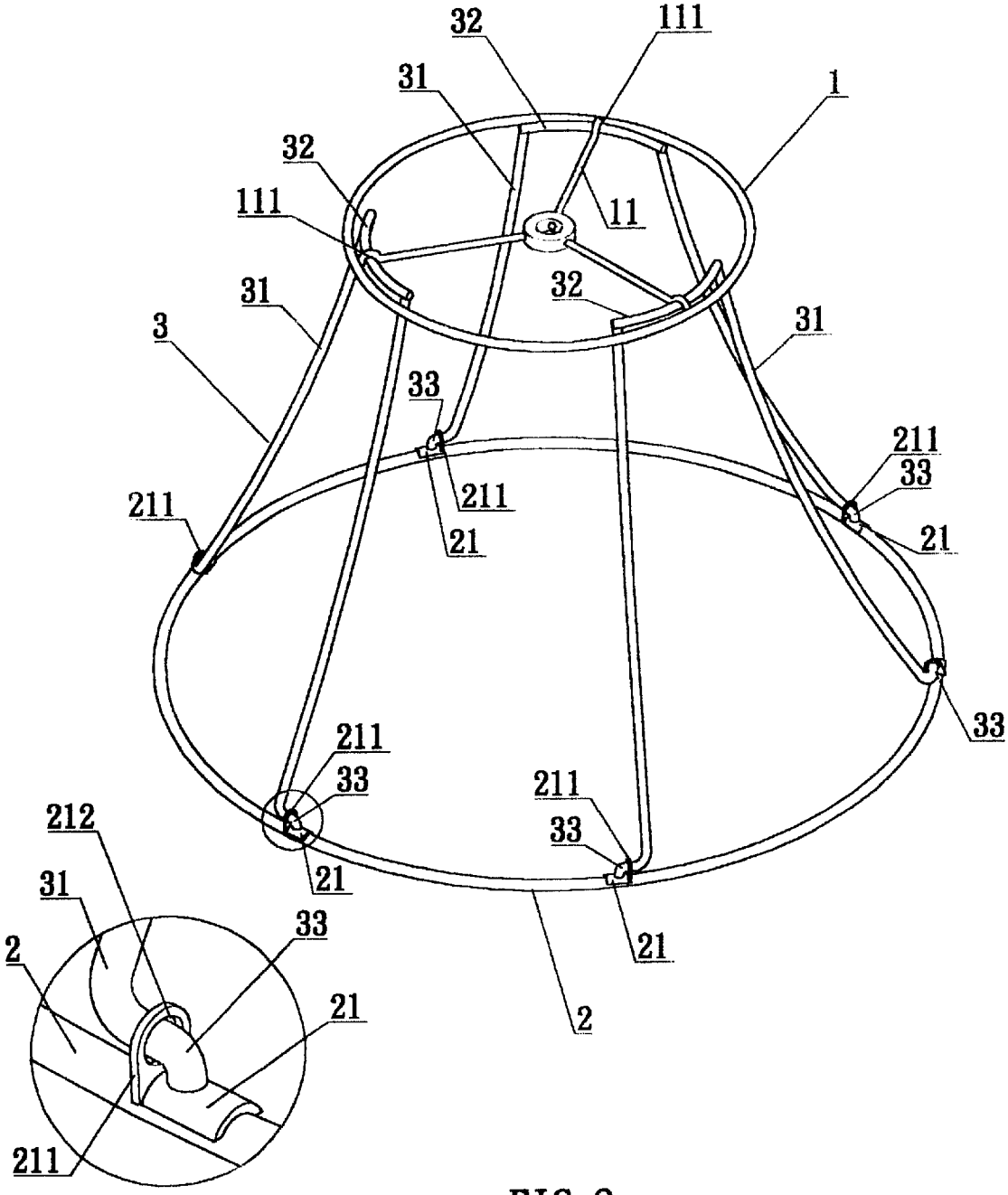
FIG. 2 is an isometric drawing of the first embodiment for the invention.
FIG. 2A is an enlarged planar drawing of the bottom ring and the support portion on the support frame.

Please refer FIGS. 1 and 2. The structure of the invention comprises of a top ring 1 on the very top of a lamp cover, a bottom ring 2, of which the perimeter is greater than that of the top ring, and a support frame 3 connecting the top ring and the bottom ring.

The top ring 1 made of metal is in round-cylinder structure and exactly hits the stand bar of a table lamp. The top ring extrudes radiantly to form support bars 11. The end of the bars are bent upward as clip hooks 111, which fix the rim of the top ring to connect and interlock the support frame 3.

The bottom ring 2 is located on the support portion of a support frame 3 and equips accordingly support bars 21 to fix the bottom of the support frame 3.

The support frame 3 comprises of dual vertical arch bars 31 and upper transversal arch bars 32, which match the curvature of the top ring. After the assembly of the upper transversal arch bar 32 on the support frame, the bars hit exactly the bottom rim of clip hooks on the top ring to fix the support frame.

Please refer FIGS. 2 to 5. There are several fixture methods to fasten the support frame and the fixture frame on the bottom ring. FIG. 2 shows the drawing of first fixture embodiment. The fixture base 21 is a ring panel structure fastened on the bottom ring 2. The lateral end of the fixture base 21 extrudes a piercing panel 211 with piercing hole 212. The bottom of the support frame 3 is bent to allow the penetration of an insert tenon, which exactly passes the piercing hole 212 on the fixture base and attaches the piercing panel 211. After the inset of the insert tenon 33 on the support frame 3 into the fixture base 21, the upper transversal arch bar 32 hits exactly the clip hooks 111 on the end of a support bar to constrain the movement of the support frame 3.

Figure 3:
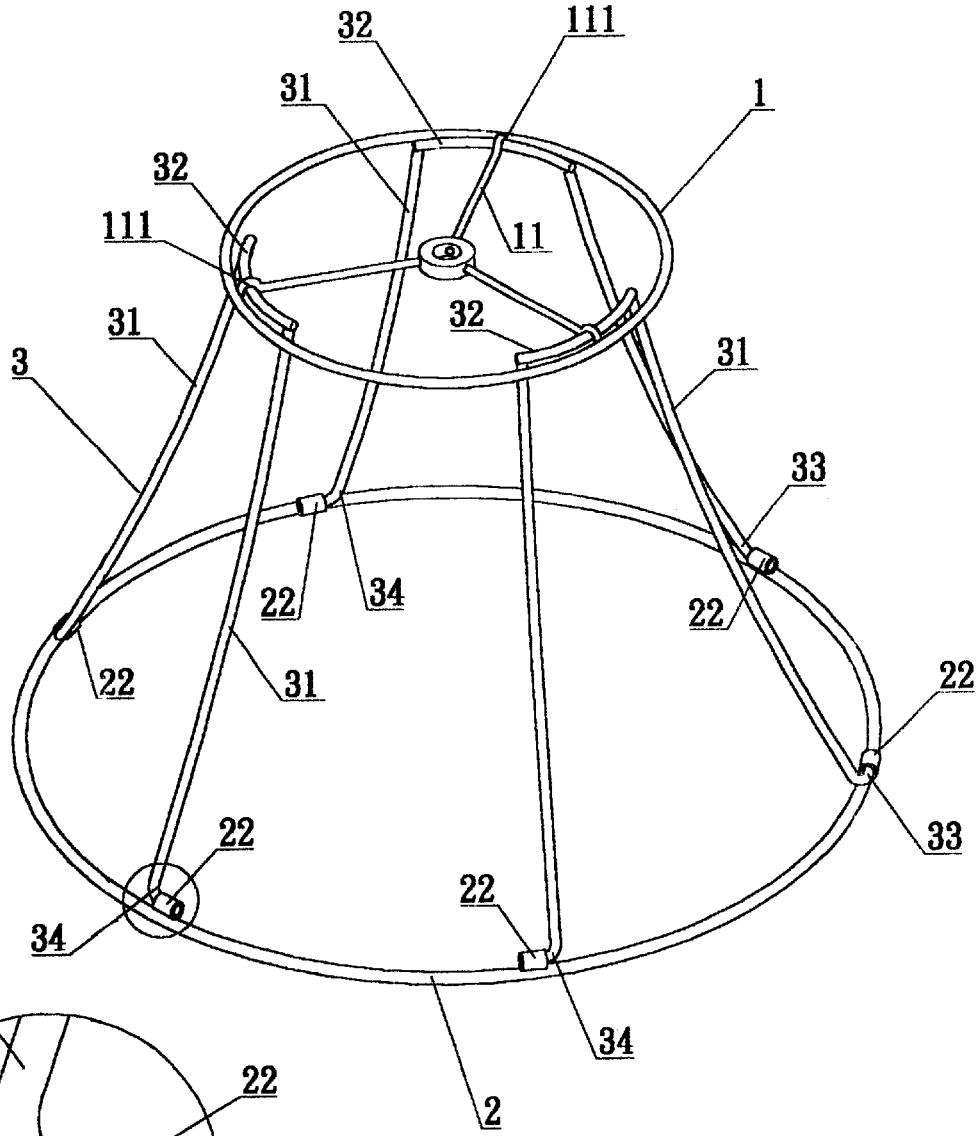
FIG. 3 is an isometric drawing of the second embodiment for the invention.
Figure 3A:
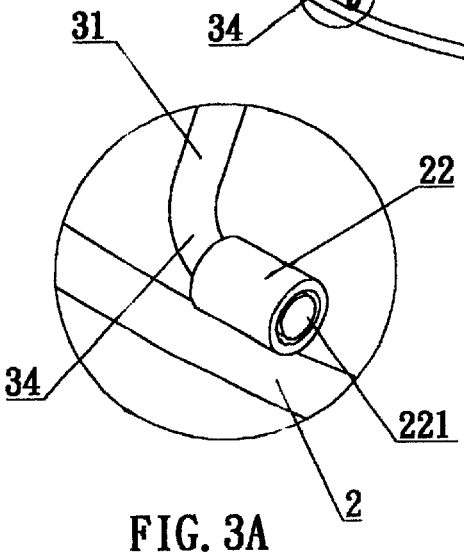
FIG. 3A is an enlarged planar drawing of the bottom ring and the support portion on the support frame.

FIG. 3 is a drawing of the secondary embodiment for the support frame and the fixture frame on the bottom ring. The fixture base 22 equipping a central piercing hole 221 is in ring structure, which is fixed on the top of the bottom ring. The bottom of the support frame 3 is bent to allow the penetration of an insert tenon 34, which exactly passes the piercing hole 221 on the fixture base. After the inset of the insert tenon 34 on the support frame 3 into the fixture base 22, the upper transversal arch bar 32 hits exactly the clip hooks 111 on the end of a support bar to constrain the movement of the support frame 3.

Figures 4, 4A:
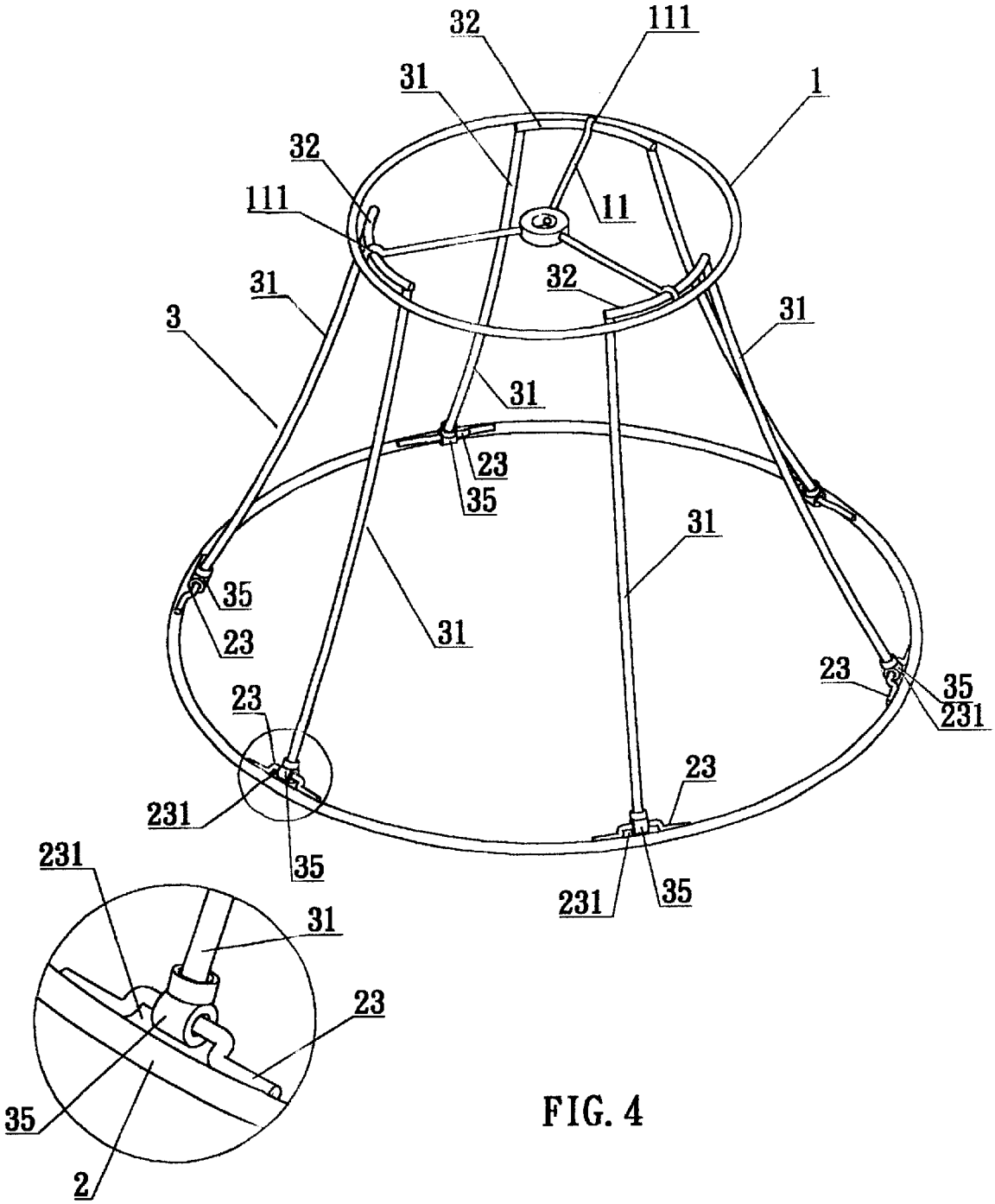
FIG. 4 is an isometric drawing of the third embodiment for the invention.
FIG. 4A is an enlarged planar drawing of the bottom ring and the support portion on the support frame.

FIG. 4 is a drawing of the third embodiment for the support frame and the fixture frame on the bottom ring. The bottom of fixture base 23 is in bar structure fixed on the top of a bottom ring. The central portion of the fixture base extrudes upward to form a container space 231 for the fixture of a support frame. The bottom of the support frame 3 equips a container space 231 for exactly passing the clip ring 35 on the convex end of the fixture base. By the fixture of the clip ring 35, the support frame is fixed firmly onto the bottom ring. Also, after positioning, the upper transversal arch bar 32 on the support frame 3 hits exactly the clip hooks 111 on the end of a support bar to constrain the movement of the support frame 3.

Figure 5:
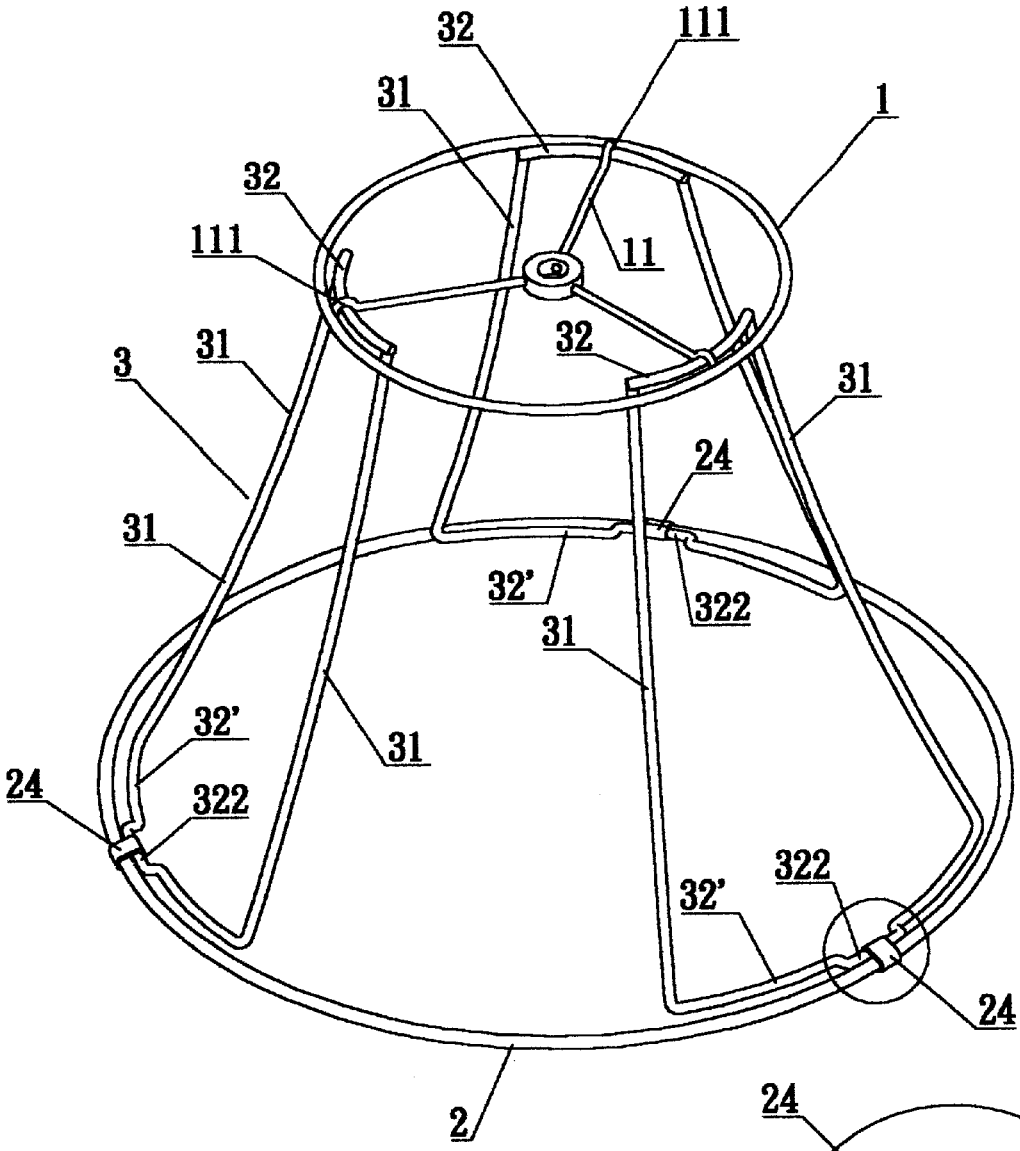
FIG. 5 is an isometric drawing of the forth embodiment for the invention.
Figure 5A:
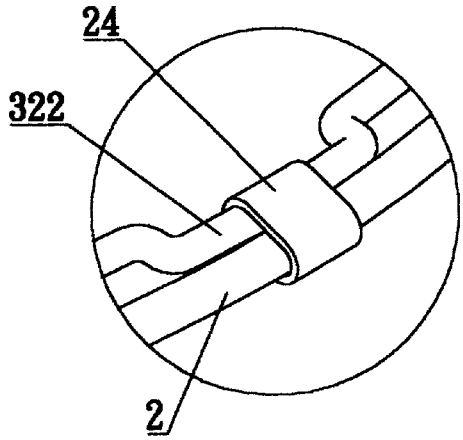
FIG. 5A is an enlarged planar drawing of the bottom ring and the support portion on the support frame.

FIG. 5 is a drawing of the fourth embodiment for the support frame and the fixture frame on the bottom ring. The support frame 3 comprises of dual vertical arch bars 31 and lower transversal arch bars 32. The lower transversal arch bars 32' fit the curvature of the bottom ring. Its central section extrudes a contact end 322, which hits exactly the inner side of the bottom ring. The fixture base 24 is located outside the contact end 322 and the bottom ring 2 to integrate the bottom ring 2 and the support frame 3 and to fix the support frame 3 onto the bottom ring 2. After positioning, the upper transversal arch bar 32 on the support frame 3 hits exactly the clip hooks 111 on the end of a support bar to constrain the movement of the support frame 3.

Figure 6:
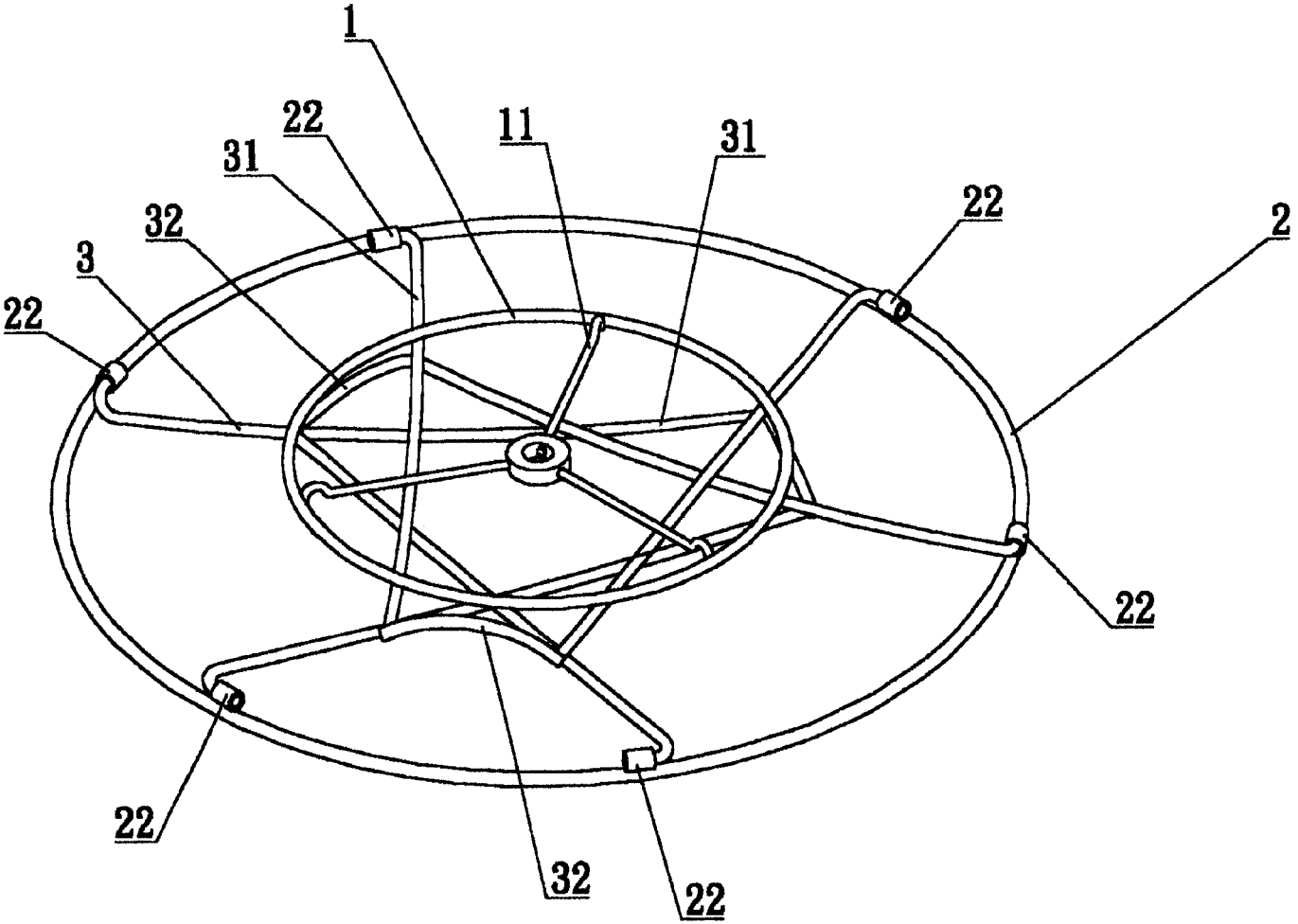
FIG. 6 is a folded and unfolded drawing of an embodiment for the invention.

Please refer FIG. 6, a folded and unfolded drawing of an embodiment for the invention. During assembly, one may lay the top ring and bottom ring together. The lamp cover can thus be assembled with minimum volume to achieve the objectives of easy assembly and to reduce storage volume and delivery cost.

Figures 7, 7A:
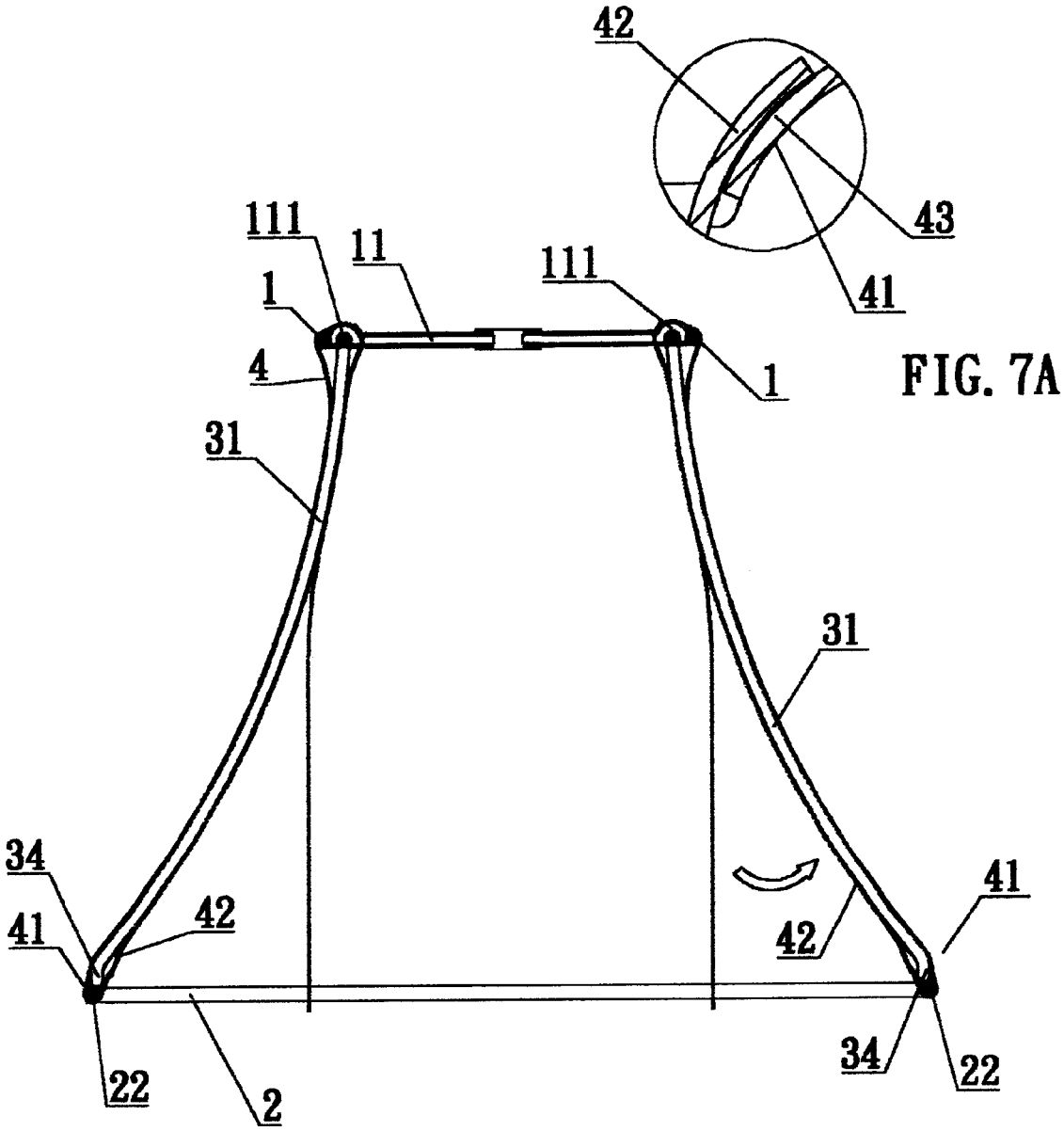
FIG. 7 is a sectional drawing of the cloth installation on a lamp cover for the invention.
FIG. 7A is a partially enlarged drawing on the adhesive portion.
Figure 8:
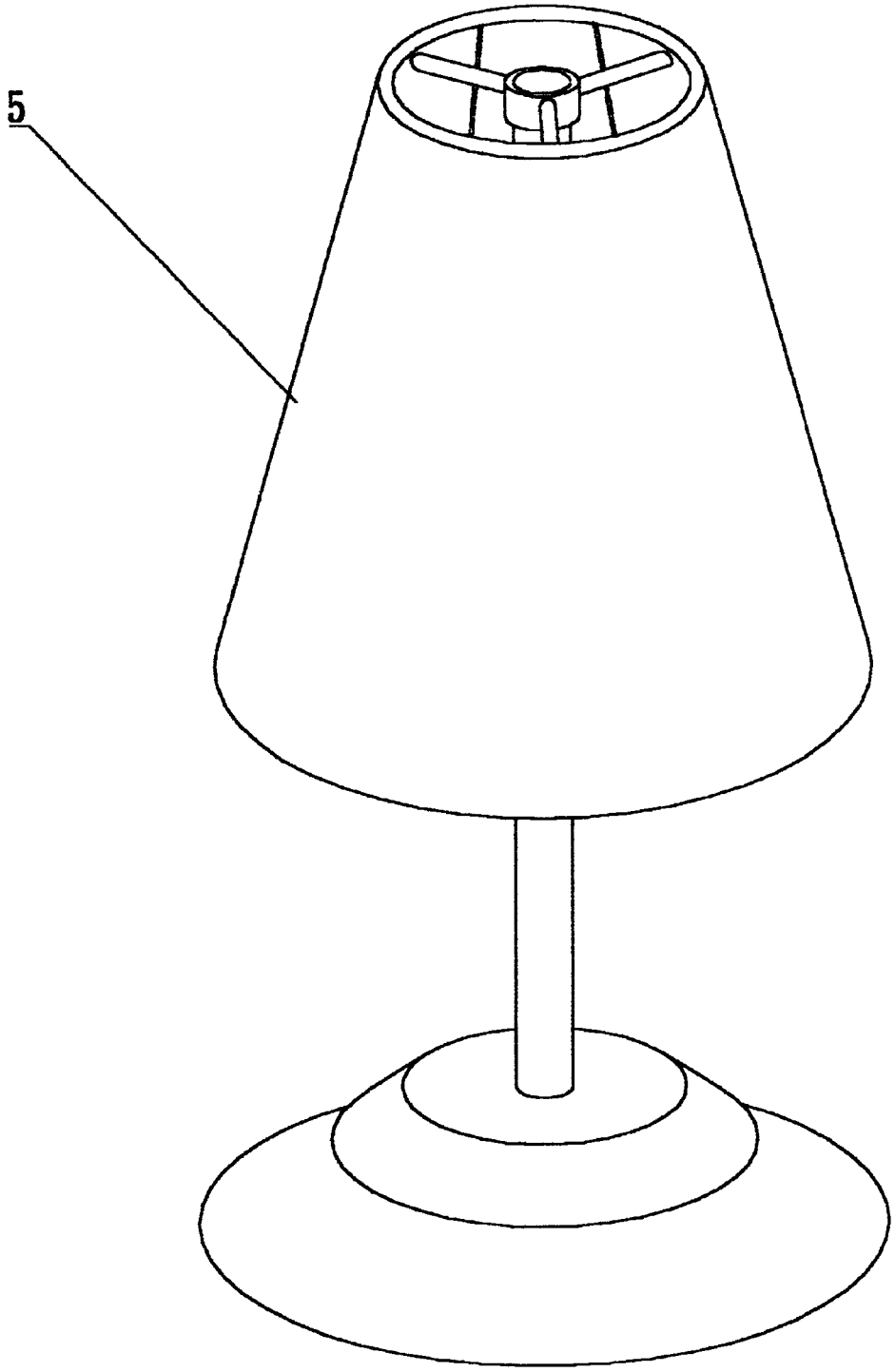
FIG. 8 PRIOR ART
FIG. 8 is an isometric drawing of the prior lamp cover.

Please refer to FIG. 7. After the assembly of lamp cover frame base, a cloth clover can be covered on the exterior area between the top ring 1 and the bottom ring 2. For the lamp cover, one may make the exterior cloth 4 tight in advance and fasten it on the rim of the support frame 3, then, lay an inner layer cloth 42 on the interior of the support frame 3. On the appropriate locations, there are adhesion bandages 43 on the inner and external cloth to wrap the support frame. The frame is not exposed and the structure of combined cloth is formed for the effect of esthetics. It can also be folded together with the lamp cover to reduce storage volume and to decrease delivery cost.

The above explanation is a substantial embodiment of the invention, which provides greater practical performance and simplification than products of prior art. Furthermore, the present invention meets all new patent application requirements and is lawfully submitted for review and the granting of the commensurate patent rights to thereby encourage the spirit of invention and its rightful protection under the patent law.

What is claimed is:

1. A collapsible lamp cover, comprising:

a) a bottom ring;

b) a plurality of support frames pivotally connected to the bottom ring, each support frame having a plurality of vertical arch bars each having an upper end, and a transverse arch bar connecting the upper ends of the vertical arch bars; and, c) a top ring having a plurality of radially extending support bars, each support bar having a clip hook portion engaging one of the transverse arch bars whereby each support frame is attached to a radially extending support bar.

2. The collapsible lamp cover of claim 1 wherein each vertical arch bar has a bottom end and further comprising a pivotal connection connecting the bottom ends to the bottom ring.

3. The collapsible lamp cover of claim 2 wherein the pivotal connection comprises a plurality of cylindrical fixture bases mounted on the bottom ring and an insert tenon on the bottom end of each vertical arch bar engaged with one of the plurality of cylindrical fixture bases.

4. The collapsible lamp cover of claim 2 wherein the pivotal connection comprises a plurality of fixture bases mounted on the bottom ring, each fixture base having an upstanding panel with a hole therethrough, and an insert tenon on the bottom end of each vertical arch bar engaged with the hole in one of the plurality of upstanding panels.

5. The collapsible lamp cover of claim 2 wherein the pivotal connection comprises a plurality of substantially U-shaped fixture bases mounted on the bottom ring and a clip ring on the bottom end of each vertical arch bar engaging one of the plurality of fixture bases.

6. The collapsible lamp cover of claim 2 wherein each support frame further comprises a lower transverse arch bar between bottom ends of the vertical arch bars, each lower transverse arch bar having a central contact portion, and wherein the pivotal connection comprises a plurality of fixture bases, one fixture base engaging each central contact portion and the bottom ring.

7. The collapsible lamp cover of claim 1 further comprising a cloth cover on an exterior and an interior of the support frames between the top and bottom rings, and an adhesion device connecting the exterior and interior covers together.

* * * * *